United States Patent [19]

Janssen

[11] Patent Number: 4,620,383

[45] Date of Patent: Nov. 4, 1986

[54] VISIBLE INDEX SYSTEMS

[76] Inventor: Alexander P. Janssen, c/o Datastrip Corporation, 1575 Avon St. Extended, Charlottesville, Va. 22901

[21] Appl. No.: 589,687

[22] Filed: Mar. 15, 1984

Related U.S. Application Data

[63] Continuation-in-part of Ser. No. 350,618, Feb. 22, 1982, abandoned.

[51] Int. Cl.[4] ..... B42F 21/00

[52] U.S. Cl. ..... 40/360; 40/359; 40/534

[58] Field of Search ..... 40/359, 360, 534, 158, 40/530, 124.4, 124

[56] References Cited

U.S. PATENT DOCUMENTS 1,614,021 1/1927 Sprenger ..... 40/360
2,178,449 10/1939 Jackson ..... 40/124.4
2,438,997 4/1948 Hall ..... 40/534
2,935,807 5/1960 Townsend et al. ..... 40/158 R

FOREIGN PATENT DOCUMENTS 115830 1/1930 Austria ..... 40/533

*Primary Examiner*—Robert Peshock
*Assistant Examiner*—Wenceslao J. Contreras
*Attorney, Agent, or Firm*—Lowe, Price, LeBlanc, Becker & Shur

[57] ABSTRACT

Pocket card type visible index systems in which the pocket cards are protected against tearing at points of stress. This may be accomplished by bonding a reinforcing material to the card holding member of the pocket card, or, alternatively, by making that member of a laminated material. An additional feature includes protecting against tearing by providing round or radius corners at the ends of the card retaining apertures formed in the member.

11 Claims, 17 Drawing Figures

VISIBLE INDEX SYSTEMS

This is a continuation-in-part of application Ser. No. 350,618, filed Feb. 22, 1982, now abandoned.

The present invention relates to visible index systems and, more particularly, to novel, improved visible index systems of the pocket card type.

Pocket card type visible index systems are described, for example, in U.S. Pat. Nos. 2,498,808 to Hall and in 3,274,715 to Janssen. In such systems, a plurality of overlapping pocket cards are supported by hinges from wire hangers carried in suitable frames. Removable cards carrying appropriate data pertaining to subjects such as customer accounts or hospital patient information are inserted into slots formed in the card holding members of the pocket cards to secure them to the latter.

In these systems, the pocket card holder has often been reinforced to keep the hinges from tearing out. One type of reinforcement heretofore employed is a folded plastic strip which is heat sealed along the top edge of the pocket card. The hinges are attached to the pocket card through this strip.

Another prior art type of reinforcement consists of a small patch of pressure sensitive tape applied to the data card holding member of the pocket card at each hinge location with the hinge being installed through the tape.

Various other attempts have been made to remedy the problem of tearing at the hinge locations of pocket cards including the application of various varnishes, lacquers, adhesives and epoxy liquids to strengthen the hinge areas of the card. Such attempts, however, have met with little success as only a small increase in strength has been found to result from such measures.

One common problem of all of these reinforcing techniques is that they do not prevent tearing in a location where that problem is perhaps as serious as it is in the hinge locations.

Specifically, cooperating (usually multiple) sets of diagonally oriented slots are provided in the corners of the card holding members. The corners of data bearing file cards or the like are inserted through these slots to detachably fix them to the pocket cards, a scheme which permits the index system to be updated simply by removing and replacing the data bearing cards. As this is done, however, and even while the data bearing cards are attached to the pocket cards, the card holding members are susceptible to tearing at the ends of these slots. This makes the pocket card useless as it is no longer capable of retaining the data bearing card in place.

I have now discovered that this problem can be readily and economically solved by reinforcing those areas of the card holding members in which the tear-susceptible ends of the slots are located with an appropriate sheeting which may also be extended to those areas of the card holding members where the hinges are attached to reinforce them.

Alternatively, the same goal can be reached by employing a card holding member of laminated construction; and tearing at the ends of the card holding slots can be reduced, if not eliminated, by rounding the ends of those slots.

Another advantage of the various reinforcing schemes described above is that they accommodate the use of straight sided hinges to attach the pocket cards to the supporting wires or hangers. This is important because the pocket card carrying capacity of the wires can thereby be significantly increased.

Still another advantage of the reinforcing schemes discussed above is that they are compatible with mass production techniques. For example, the reinforcement can be applied in continous or intermittent strip form to the edges of a continous roll of card holder forming material and the latter then separated into separate members, slotted, and equipped with hinges and any other required components such as index tab holders to complete the pocket card assembly.

It is the primary object of the present invention to provide novel, improved pocket cards for visible index systems of the pocket card type.

Related and also important but more specific objects of my invention reside in the provision of pocket cards as aforesaid:

which are more durable and less subject to tearing than those currently available;

in which the foregoing goal is achieved by covering those areas where tearing is apt to occur with an appropriate reinforcement and/or by fabricating the card holding member of the pocket card from a suitable laminate, and/or by rounding the ends of elongated slots provided in that member to retain a data bearing card in place;

which can be economically manufactured;

in which the foregoing goal is achieved by employing straight-sided rather than conventional T-shaped or inverted T-shaped hinges to connect the pocket card to a supporting hanger.

The foregoing and other objects and advantages of the present invention will become apparent from the appended claims and from the following detailed description and discussion of the invention taken in conjunction with the accompanying drawings, wherein:

Figure 1:
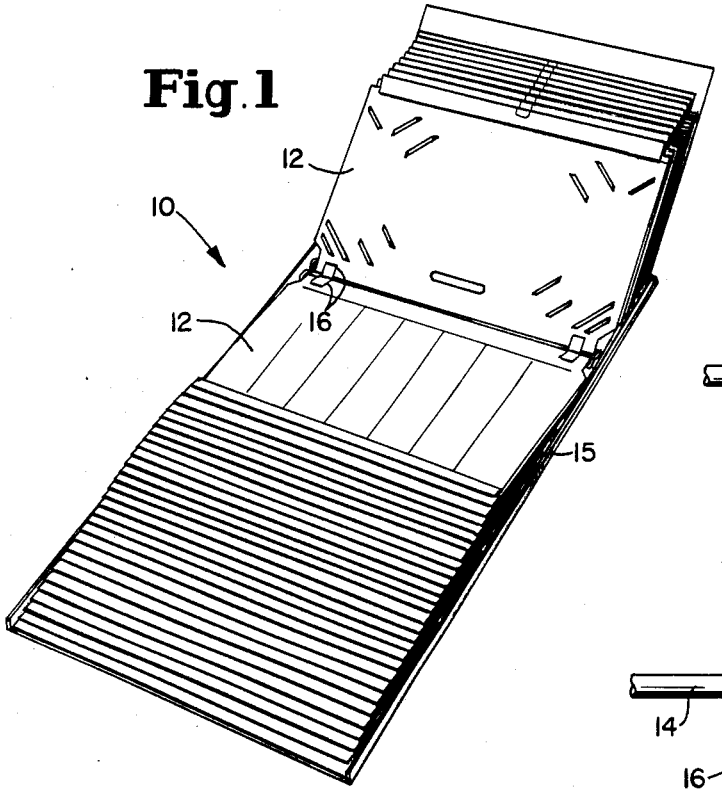
FIG. 1 is a perspective view of a prior art, desk top, visible index system of the pocket card type.
Figure 5:
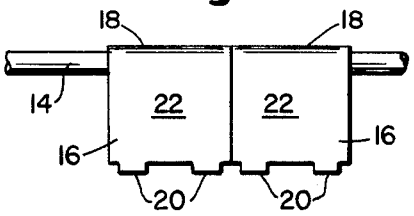
FIG. 5 is a partial plan view of the pocket card hinge of the present invention.
Figure 4:
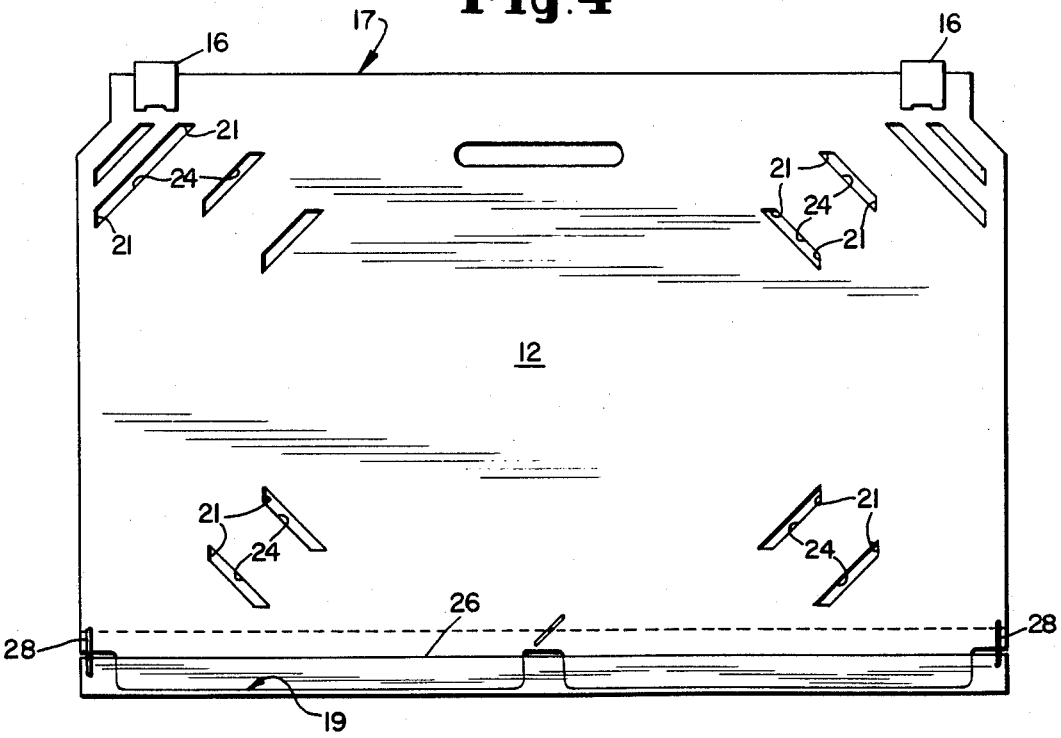
FIG. 4 is a plan view of a pocket card having a hinge according to the present invention.
Figure 6:
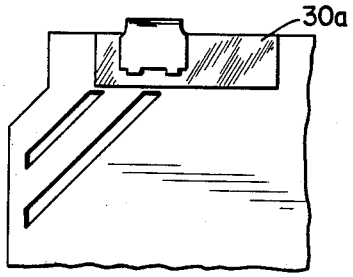
Fig. 6 PRIOR ART
FIG. 6 is a partial plan view showing a prior art pocket card hinge reinforcement.

The embodiment of the present invention shown in FIGS. 1, 4, and 5 is a desk top visible index system 10 of the pocket card type. It includes rectangular pocket cards 12 mounted on a series of wire hangers 14 by hinges 16. The latter are, in turn, mounted in a holder 15 in the manner described in my earlier issued and above-cited U.S. Pat. No. 3,274,715 which is hereby incorporated by reference.

In FIG. 4, there is shown a card holding member 12 without the reinforcement features of the present invention. Each card holder 12 has a plurality of card retaining slots or apertures 24 extending diagonally across the holder 12 in the area adjacent each of the four corners. These slots 24 are for the purpose of retaining cards or other information in sheet form and the slots 24 may extend at any desired angle such as about 45 degrees relative to the top 17 and bottom 19 edges of the holder 12. Each slot 24 is generally of an elongated, narrow rectangular shape and, in one embodiment, has the end surfaces 21 thereof extending substantially parallel to the respective adjacent edge of the card holder 12.

The slots 24 may be formed in any conventional manner such as by operation of a punch and die assembly. In one embodiment, the card holder 12 has a length of approximately $8\frac{1}{4}''$ and a width of approximately $5\frac{3}{8}''$; the slots 24 are approximately 3/32" in width and with a length ranging from about $\frac{3}{4}''$ to about $1\frac{1}{4}''$. A pocket tip 26 of a suitable material such as polyester or acetate is provided along the lower edge of the holder 12. The pocket tip 26 is of a generally U-shaped configuration, extending upwardly adjacentthe lower front and back surface of the card holding member 12 and being attached to member 12 by staples 28 or similar means.

Figure 2:
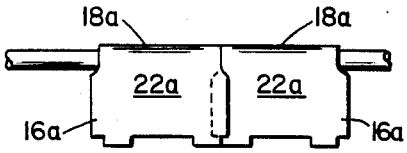
Fig. 2 PRIOR ART
FIG. 2 is a partial plan view of a prior art pocket card hinge.
Figure 3:
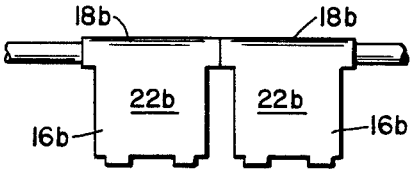
Fig. 3 PRIOR ART
FIG. 3 is partial plan view of another prior art pocket card hinge.

As shown in FIG. 5, each hinge 16 includes a barrel 18 at one end thereof for receiving the wire hanger 14 and a pair of legs or prongs 20 which extend through the card holder 12 and are bent up adjacent the rear surface of the holder 12 in a conventional manner. The hinge 16 preferably employed in the present invention is constructed with the barrel portion 18 of a length equal to that of the main body 22 of the hinge 16. Thus the present hinge 16 construction is distinguished from such prior art hinges as shown in FIGS. 2 and 3. The construction of hinge 16 results in the overall length of the hinge being reduced thus maximizing the number of hinges that can be strung on a wire, while at the same time preventing the build up problem which has occurred with prior hinge configurations. Hinges of other configurations may also be employed with the pocket card reinforcement to be described hereinafter, although such hinges will not have the advantageous features of the hinge 16, as previously discussed. The hinges 16 are generally installed in pairs on the upper edge of the card holder 12 adjacent the corners, as showh in FIG. 4, by means of the hinge legs 20.

Figure 7:
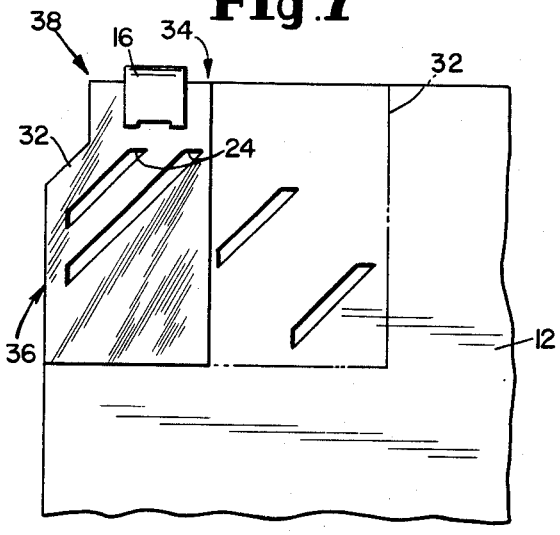
FIGS. 7–10 are partial plan views of pocket cards reinforced against tearing in accord with the present invention.

In FIGS. 7–17, there are shown various embodiments of a pocket card reinforcement of the present invention. As shown in FIG. 7, a reinforcing patch 32 in sheet form is attached in planar engagement with the card holder 12 by means such as heat sealing, pressure sensitive adhesive or similar means. The reinforcing patch described in this and the succeeding embodiments may be of any suitable reinforcing material in sheet form including, for example, a polymeric material such as polyester film, polyethylene, polyvinyl acetate or a similar material. In one embodiment, the reinforcing material employed was a 0.002 inch thick sheet of Mylar, a polyester film sold by E. I. DuPont de Nemours and Co. Other reinforcing materials which may be employed include: Tyvek, a spun bonded olefinic material sold by E. I. DuPont de Nemours and Co.; and metal shim materials, of steel or brass, for example, and having a thickness such as about 0.002 inches.

In the embodiment of FIG. 7, the patch 32 is of a size such that it extends along both the top 34 and side 36 edges which define the upper corner portion 38 of the card holder 12 wherein one of the hinges 16 is attached, including the area in which the hinge 16 is attached and also the area wherein one or more diagonal slots 24 are provided in the card holder 12. Generally in the construction of the present card holder 12, the slots 24 will be provided and the hinges 16 installed after the reinforcing patch 32 has been applied. As shown in dashed lines in FIG. 7, the reinforcing patch 32 may extend to approximately the mid-point of the width of the holder 12. A similar patch 32 will be applied at the other top corner (not shown) of the holder 12, thus providing reinforcement at each corner area where a hinge 16 and at least one aperture 24 are located.

Figure 8:
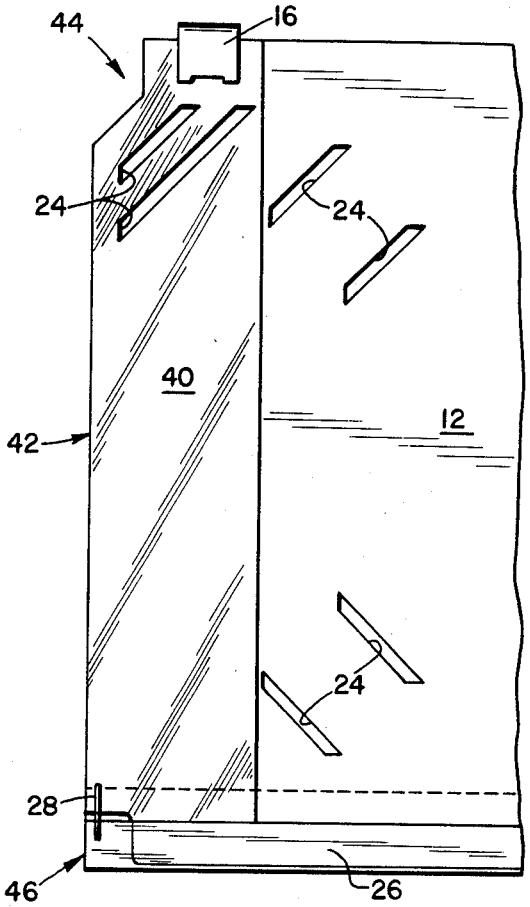

In FIG. 8, there is shown an embodiment of the present invention in which the reinforcement patch 40 extends along one complete side edge portion 42 of the card holder 12 from bottom to top, thus providing reinforcement over one complete side portion of the holder 12, including the upper 44 and lower 46 corners adjacent side edge 42. It is again pointed out that the reinforcement patch 40 covers the area of the holder 12 wherein at least one hinge 16 is secured to the holder 12, and also covers the area wherein at least one diagonal slot 24 is located. A similar reinforcement patch 40 may be provided along the opposite side (not shown) of the card holder 12.

Figure 9:
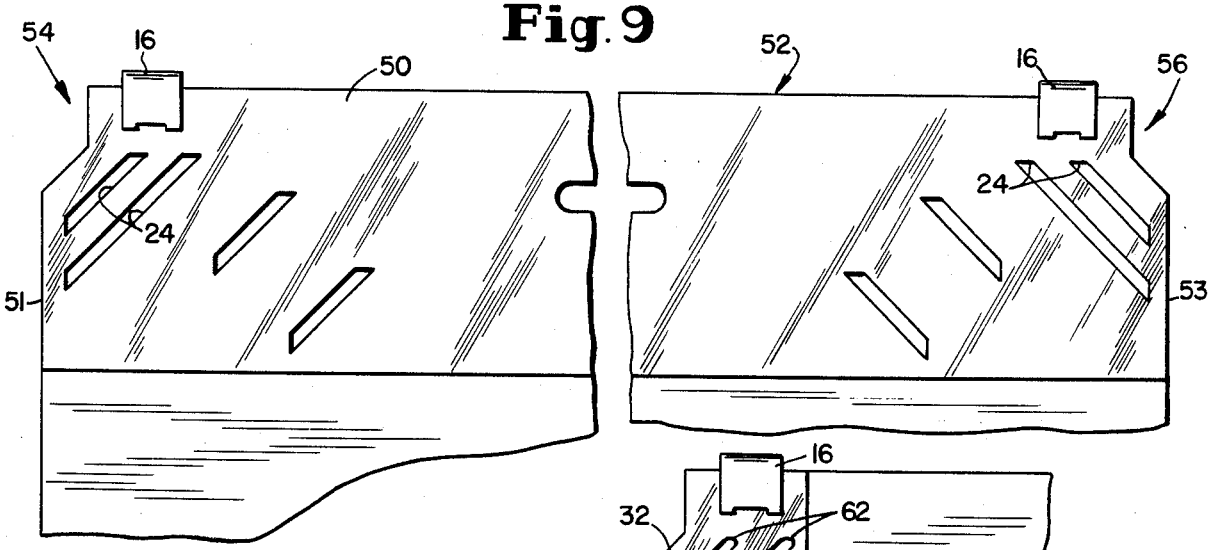

In the embodiment of FIG. 9, the reinforcement patch 50 extends along the top edge 52 of the pocket card holder 12 across the entire width of the holder 12 from one side to the other and including a substantial portion of the sides 51, 53, at least to a position below one of the slots 24 at each corner 54, 56 of the holder 12. Thus reinforcement is provided over the entire top portion of the card holder 12 including the top corners 54, 56 adjacent top edge 52. The reinforcing patch 50 covers the area in which each of the two hinges 16 is located along the top edge 52 of the holder 12, and also the area wherein at least one diagonal slot 24 is located adjacent each corner 54, 56.

Figure 10:
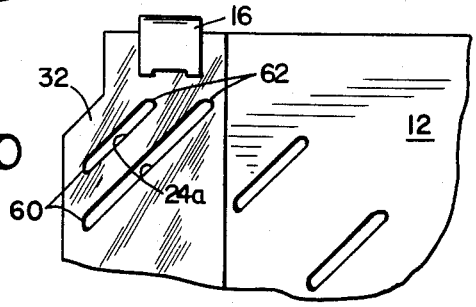
Figure 13:
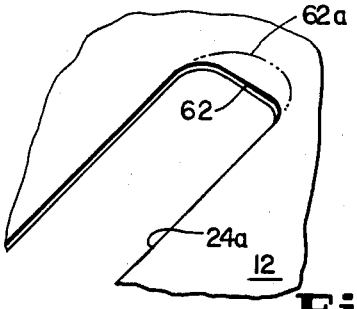
FIG. 13 is an enlarged partial plan view of an alternative embodiment of the card retaining apertures employed in the invention.

The embodiment shown in FIG. 10 is similar to that of FIG. 7, with the exception that the slots **24*a* are formed with round or radius corners at each end 60, 62 of each slot 24*a*. Such rounded corners may be formed in any conventional manner, such as by operation of a suitably shaped punch assembly. The round corners at the ends of the slots 24 assist in protecting against an initial tear of the reinforcing patch 32 which could be experienced if the slot 24*a* had a sharp edge which projected into the patch 32 during use of the card holder 12. In one embodiment, as shown in FIG. 13, the two corners which define each end 60, 62 of the rectangular aperture 24*a* are rounded. Alternatively, the ends 60*a*, 62*a* may be formed in a generally semicircular shape, as shown in dashed lines in FIG. 13**.

Figure 11:
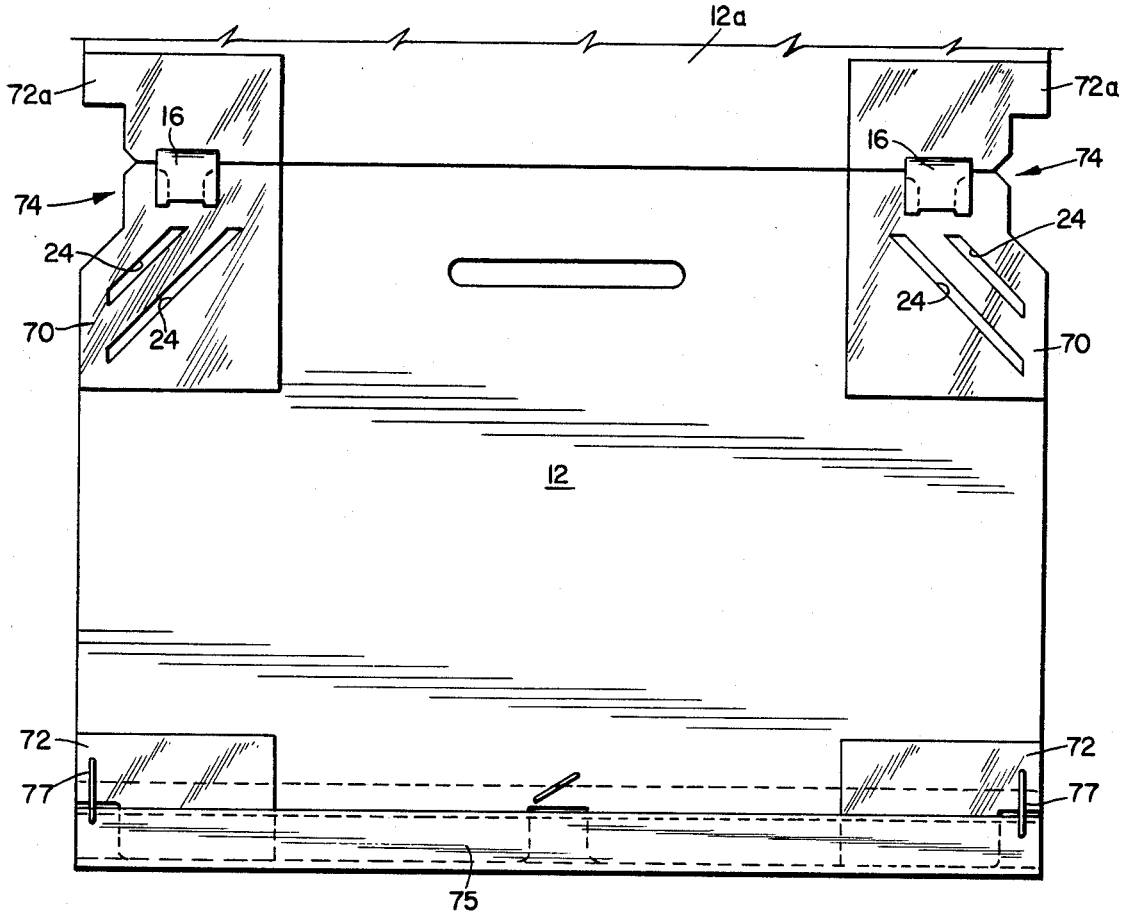
FIG. 11 is a view of another pocket card in accord with the principles of the present invention; it also depicts pictorially one technique for mass producing pocket cards in accord with the principles of the invention.

In FIG. 11 there is shown an embodiment of the invention in which reinforcing patches 70, 72 are applied to the upper and lower corner portions, respectively, on both the left and right side of the pocket card 12. In the manufacture of the card holders 12, as successive adjacent holders 12, **12*a* are passed in continuous sheet form through the area wherein reinforcing material is applied, the reinforcing material is of a size and shape which allow one continuous segment to form both the top reinforcing patch 70 on one card holder 12, and also the bottom reinforcing patch 72***a* on the next adjacent holder 12*a*. In a similar manner, the lower corner patches 72 on card holder 12 are initially formed of a segment of reinforcing material which is also employed as the upper patch on the next adjacent pocket card (not shown) below holder 12. The reinforcing material may be cut to the desired size and shape by any conventional means. This method may also be employed to apply reinforcing material to only the upper or only the lower corner portions, by the use of reinforcing material of the appropriate size.

It is pointed out that the upper reinforcing patches 70 at each top corner of the pocket card holder 12 in FIG. 11 provide reinforcement over the area of the holder 12 wherein the hinge 16 is secured to the holder 12, and also the area wherein at least one diagonal slot 24 is located. Subsequent to the application of the reinforcing material to form the patches 70, 72, the hinges 16 are secured to each card holder 12, the slots 24 are punched and the continuous sheet material is separated into the individual holders 12, by the use of conventional means well known in the field of the invention. A pocket tip 75, of the type previously described, is provided along the lower edge of the holder 12 and this pocket tip 75 is attached to member 12 by staples 77. In so doing, the staple 77 passes into the reinforcing patch 72 which provides greater tear resistance.

Although the foregoing description has been concerned with the application of reinforcing material to one side of the planar card holder member 12, it is also within the scope of the present invention to apply such reinforcing material to both sides, i.e., front and back surfaces, of member 12 utilizing the procedures previously discussed.

Figure 12:
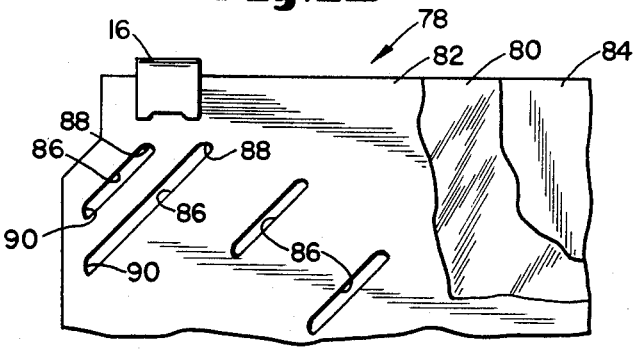
FIG. 12 is a partial plan view of a pocket card which is made more durable and less susceptible to wear and tear in accord with the principles of the present invention by making the card holding member from a laminated material and by rounding the ends of the slots formed in that member to attach a data bearing, card type component to it.

In a further aspect of the invention, as shown in FIG. 12, there is employed a pocket card holder 78 constructed of a reinforced material in the form of a laminate of polymeric sheet material 80 sandwiched between two layers 82, 84 of paper. This laminated card holder 78 has been found to be particularly useful when used in combination with slots or apertures 86 having round or radius corners at each end 88, 90. The round corners protect the inner layer of polymeric material 80 from an initial tear that would be experienced if the aperture 86 had a sharp or crossed surface edge in one of the paper layers 82, 84 which would thus create a weak area or tear point in the polymeric film 80. Various embodiments of the round or radius corners at the ends 88, 90 may be employed, corresponding to the embodiments shown and described in connection with FIGS. 10 and 13.

A particular paper-polymeric laminate which has been employed with good results is a laminate sold by the Keene Corporation of East Providence, R.I. under the designation PMP 2-2-2, containing a 0.002" thick sheet of Mylar polyester, sandwiched between two 0.002" thick sheets of paper to produce a product having a total thickness of 0.0064".

Figure 14:
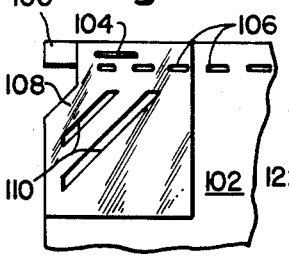
FIGS. 14–17 are partial plan views of pocket cards reinforced in accord with the present invention.

In the embodiment as shown in FIG. 14, a bar pocket construction is employed for use in mounting the pocket cards in a holder. This construction includes a bar member 100, of heavy cardboard or other suitable material, which is attached along the back of the upper surface of the card holder 102 by means of wire stitches 104 spaced at intervals along the upper surface of the holder 102. The outer ends of the bar 100 are utilized in mounting the card holder 102 in a suitable holder. A series of small hinging apertures 106 are located along the upper surface of the holder 102 just below the bar member 100.

In accordance with procedures outlined previously, a sheet of reinforcing material 108 is applied over the corner area of the holder 102, including the area in which hinging apertures 106 and card retaining apertures 110 are to be formed, and such apertures 106, 110 are then formed so as to extend through the card holder 102 and the overlying reinforcing material 108. The attachment of the bar 100 to the card holder 102 by stitches 104 may be accomplished either before or after the reinforcing material 108 is applied.

Figure 15:
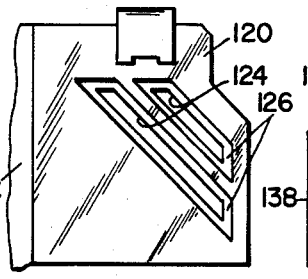

In the embodiment of FIG. 15, the reinforcing material 120 is applied over the corner area of the card holder 122, so that the material 120 is located substantially adjacent to and extending around the periphery of the one or more card retaining apertures 124 in the corner portion of the holder 122. The inner edge of the reinforcing material 120, however, is spaced slightly from each aperture 124, leaving a small portion 126 of the card holder 122 extending around the periphery of each aperture 124 which is not covered by reinforcing material 120.

Figure 16:
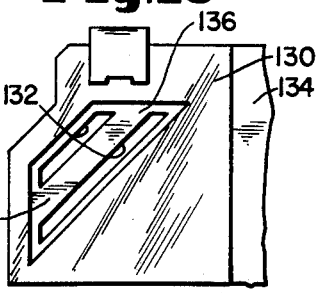

The embodiment shown in FIG. 16 is similar to FIG. 15, except that the reinforcing material 130 extends around the periphery of a plurality of card retaining apertures 132 in card holder 134, so that a portion 136 of card holder 134 extending around the periphery of the overall aperture 132 area is not covered by reinforcing material 130, including all of the area 138 located immediately between adjacent apertures 132.

Figure 17:
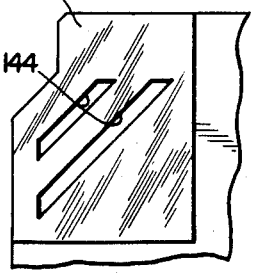

In FIG. 17 there is shown an embodiment of the invention in which reinforcing material 140 is applied over a corner area of the pocket card holder 142, including the area in which card retaining slots or apertures 144 are to be formed, in a manner as described in connection with FIG. 7. Such a reinforced pocket card holder 142, having increased strength and resistance to tearing in accordance with the present invention, may be utilized in any manner known in the art, with suitable attachment means being provided as necessary to install the card holder 142 for use in a visible index system.

It is pointed out that, while only one top corner of the card holder is shown in some of the present drawings, the reinforcement of the present invention is advantageously employed in each top corner area of the card holder. It is also within the scope of the invention to cover the entire card holder surface with reinforcing material.

Tests conducted with reinforced pocket card holders of the present invention have shown that resistance to tearing was increased by an average of at least as much as 70% as compared to pocket cards which were not reinforced. In carrying out such tests, the amount of tension applied far exceeded that to which such pocket cards would be subjected during normal use.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What I claim and desire to have secured by Letters Patent of the United States is:

1. A reinforced pocket card for a visible index system, comprising: A planar, generally rectangular card holder; at least one hinge mounted adjacent the upper edge and at one corner of said card holder for attaching the card holder to a pocket card supporting hanger; a sheet of reinforcing material so bonded in coplanar relation to said card holder adjacent said corner thereof that said reinforcing material overlies the portion of the card holder in which the hinge is mounted, said reinforcing material extending along at least a portion of each of the two edges which define said corner; and at least one elongated aperture in the card holder adjacent said corner and oriented at an angle relative to said edges of said card holder through which a corner of a card can be inserted to attach the card to the card holder, said aperture extending through the card holder and the overlying reinforcing material so that said reinforcing material will keep the card holder material at the end of said aperture from being torn.

2. The pocket card of claim 1 wherein the hinge comprises a main body portion and a barrel at the upper end of the main body portion for receiving said hanger, said barrel equaling the main body portion in length and the sides of the hinge being parallel from end-to-end of the hinge.

3. The pocket card of claim 1 wherein the aperture has round or radius corners at the ends thereof and the card holder is thereby protected against tearing.

4. The pocket card of claim 1 wherein the reinforcing material extends completely along one side of the card holder.

5. The pocket card of claim 1 wherein the reinforcing material extends completely along the top edge of the card holder.

6. The pocket card of claim 1 wherein said reinforcing material is a polyester.

7. A reinforced pocket card for a visible index system, comprising: a planar, generally rectangular card holder made from a laminate composed of a polymeric sheet material adhesively secured between two layers of paper, said card holder having at least one aperture adjacent a corner of said card holder, and said aperture having round or radius corners at the ends of said aperture to protect the laminate of which the card holder is made against tearing, hinges mounted at the upper edge of said card holder adjacent the corners thereof, each hinge comprising a main body portion and a barrel at the upper end of the main body for receiving a pocket card supporting hanger, said barrel equaling the main body portion of said hinge in length and the sides of the hinge being parallel from end-to-end thereof.

8. The pocket card of claim 1 wherein the hinge comprises a series of hinging apertures along the upper edge of said card holder, said apertures extending through said card holder and said reinforcing material bonded to said card holder, and fastening means for mounting the upper edge of said pocket card on a supporting hanger of the bar type, said fastening means extending through said card holder and said reinforcing material bonded to said card holder to attach said card to said hanger.

9. The pocket card of claim 8 wherein said fastening means comprises wire stitches.

10. A reinforced pocket card for a visible index system, comprising: a planar, generally rectangular card holder; a series of hinging apertures along the upper edge of said card holder; a bar member extending along the back of the upper edge of said card holder above said apertures; at least one fastening means adjacent the upper edge and at one corner of said card holder for attaching the card holder to the bar member; a sheet of reinforcing material so bonded in coplanar relation to said card holder adjacent said corner thereof that said reinforcing material overlies the portion of the card holder in which said fastening means is mounted, said reinforcing material extending substantially along at least a portion of each of the two edges which define said corner; and at least one elongated aperture in the card holder adjacent said corner and oriented at an angle relative to said edges of said card holder through which a corner of a card can be inserted to attach the card to the card holder, said aperture extending through the card holder and the overlying reinforcing material so that said reinforcing material will keep the card holder material at the end of said aperture from being torn.

11. The pocket card holder of claim 10 wherein said fastening means comprises wire stitches.

* * * * *